US006761559B1

(12) United States Patent
Chen et al.

(10) Patent No.: US 6,761,559 B1
(45) Date of Patent: Jul. 13, 2004

(54) GAS-EXHAUSTING MODULE STRUCTURE SUITED FOR A CONTINUOUS TYPE OVEN

(75) Inventors: A-Tzu Chen, Chung Li (TW); Chang-Fa Chen, Chung Li (TW); Cheng-Yao Wang, Chung Li (TW)

(73) Assignee: Tangteck Equipment Inc., Tao Yuan Hsien (TW)

( * ) Notice: Subject to any disclaimer, the term of this patent is extended or adjusted under 35 U.S.C. 154(b) by 0 days.

(21) Appl. No.: 10/434,187

(22) Filed: May 9, 2003

(51) Int. Cl.[7] ..... F27B 9/28
(52) U.S. Cl. ..... 432/59; 126/293; 126/312; 126/80; 454/39; 454/67; 110/162
(58) Field of Search ..... 432/59, 8; 110/162; 126/293, 312, 80; 454/39, 67

(56) References Cited

U.S. PATENT DOCUMENTS 3,448,917 A * 6/1969 Dewey et al. ..... 417/151
3,570,423 A * 3/1971 Hemmingson ..... 110/160
4,487,137 A * 12/1984 Horvat et al. ..... 110/160

* cited by examiner

*Primary Examiner*—Jiping Lu
(74) *Attorney, Agent, or Firm*—Rosenberg, Klein & Lee

(57) ABSTRACT

A gas-exhausting module structure includes a casing having a first open end and a second open end. An air-exhausting channel is defined within the casing. The air-exhausting channel has an upper opening that is lower than the second open end of the casing. A blower comprising a chamber, an air outlet, and an air inlet is provided. The blower is in communication with the air-exhausting channel. The air inlet of the blower is connected to an air-sucking box. When power of the blower is turned on, it sucks air into the air-exhausting channel and expels high-pressure air through the upper opening of the air-exhausting channel.

6 Claims, 6 Drawing Sheets

GAS-EXHAUSTING MODULE STRUCTURE SUITED FOR A CONTINUOUS TYPE OVEN

BACKGROUND OF THE INVENTION

1. Field of the Invention

The present invention relates to a gas-exhausting module structure. More particularly, the present invention relates to a gas-exhausting module structure that is suited for a continuous type oven.

2. Description of the Related Art

Surface mount technique (SMT) has improved on many weaknesses in the conventional type of penetrated-hole circuit board, application of such technology has reduced the cubic measurements of a product, increased its density, saved manpower and achieved the precision that could not be performed by manpower, therefore, it is highly commended by the manufacturing industry, many peripheral equipment have been introduced since, such as surface adhering components, positioning machine, spot welder, soldering furnace, etc.

A continuous type oven is designed to achieve welding purposes by heating the SMD component pins, solder and working piece with a heater. A conventional type of continuous heating oven involves a proper conveyance unit, which serves to convey a printed circuit board (PCB) through the heater in the machine unit to enable welding operations.

In operation, the continuous type oven generates gaseous byproducts that may cause harm to human beings. To comply with the environmental codes, a proper gas-exhausting device is usually needed. FIG. 1 is a schematic cross-sectional diagram illustrating a prior art continuous type oven equipped with a gas-exhausting device. The gas-exhausting device comprises a vertical exhaust pipe 10*a* having one end in communication with the gas-generating area (not shown) to expel process gas generated by the heater through the exhaust pipe 10*a*. An air conveying tube 20*a* is installed within the exhaust pipe 10*a*. The air conveying tube 20*a* has one end connected to an air compressor (not shown) for providing high-pressure air to the air conveying tube 20*a*. The high-pressure air jetting out from the other end of the air conveying tube 20*a* carries gas away due to siphon effects.

However, according to the above-mentioned gas-exhausting device, flux residues condense and drop on the substrates while gas passes through the exhaust pipe 10*a*. The flux residues might cause substrate damages. Sometimes, condensed residues adhere to the sidewalls of the exhaust pipe 10*a* and inner sidewalls of the air conveying tube 20*a*, and eventually clogging the air exhausting system. Furthermore, the prior art gas-exhausting device needs a costly air compressor to provide high-pressure air.

SUMMARY OF THE INVENTION

Accordingly, one object of the invention is to provide an improved gas-exhausting module structure. A separated air channel is disposed inside a casing. When gas passes through the channel, gas residues will not adhere to sidewalls of the channel. Also, the channel has an upper opening with large cross section area, thereby eliminating clogging problems. An air compressor is omitted to save cost.

It is another object of the present invention is to provide an improved gas-exhausting module structure having a casing and a gas residue collecting channel disposed at a lower portion of the casing.

To achieve these and other advantages and in accordance with the purposes of the present invention, as embodied and broadly described herein, the present invention provides a gas-exhausting module structure is provided. The gas-exhausting module structure includes a casing having a first open end and a second open end. An air-exhausting channel is defined within the casing. The air-exhausting channel has an upper opening that is lower than the second open end of the casing. A blower comprising a chamber, an air outlet, and an air inlet is provided. The blower is in communication with the air-exhausting channel. The air inlet of the blower is connected to an air-sucking box. When power of the blower is turned on, it sucks air into the air-exhausting channel and expels high-pressure air through the upper opening of the air-exhausting channel.

Other objects, advantages and novel features of the invention will become more clearly and readily apparent from the following detailed description when taken in conjunction with the accompanying drawings.

DETAILED DESCRIPTION OF THE PREFERRED EMBODIMENTS

Figure 1:
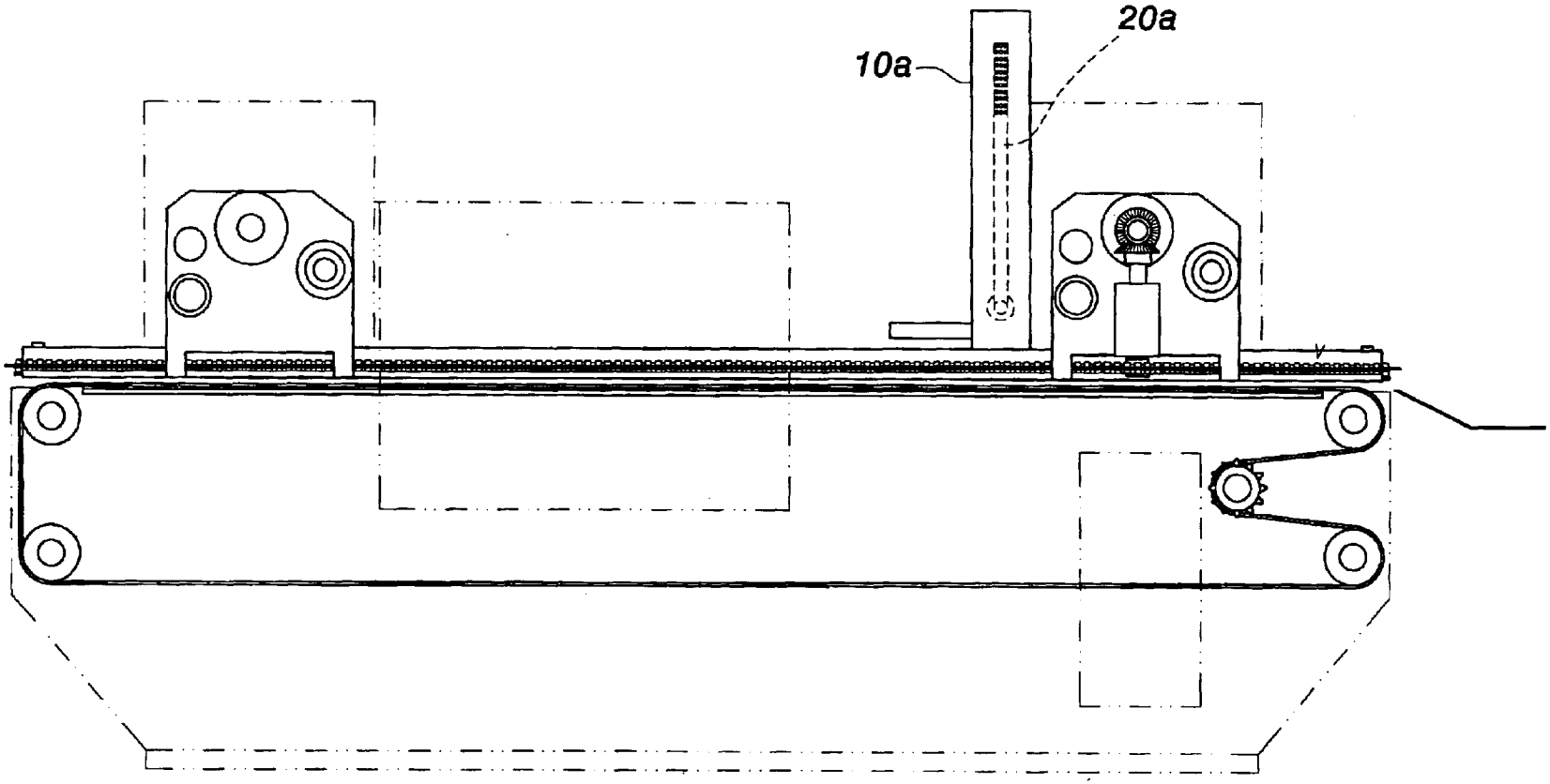
FIG. 1 PRIOR ART
FIG. 1 is a schematic cross-sectional diagram illustrating a prior art continuous type oven equipped with a gas-exhausting device.
Figure 2:
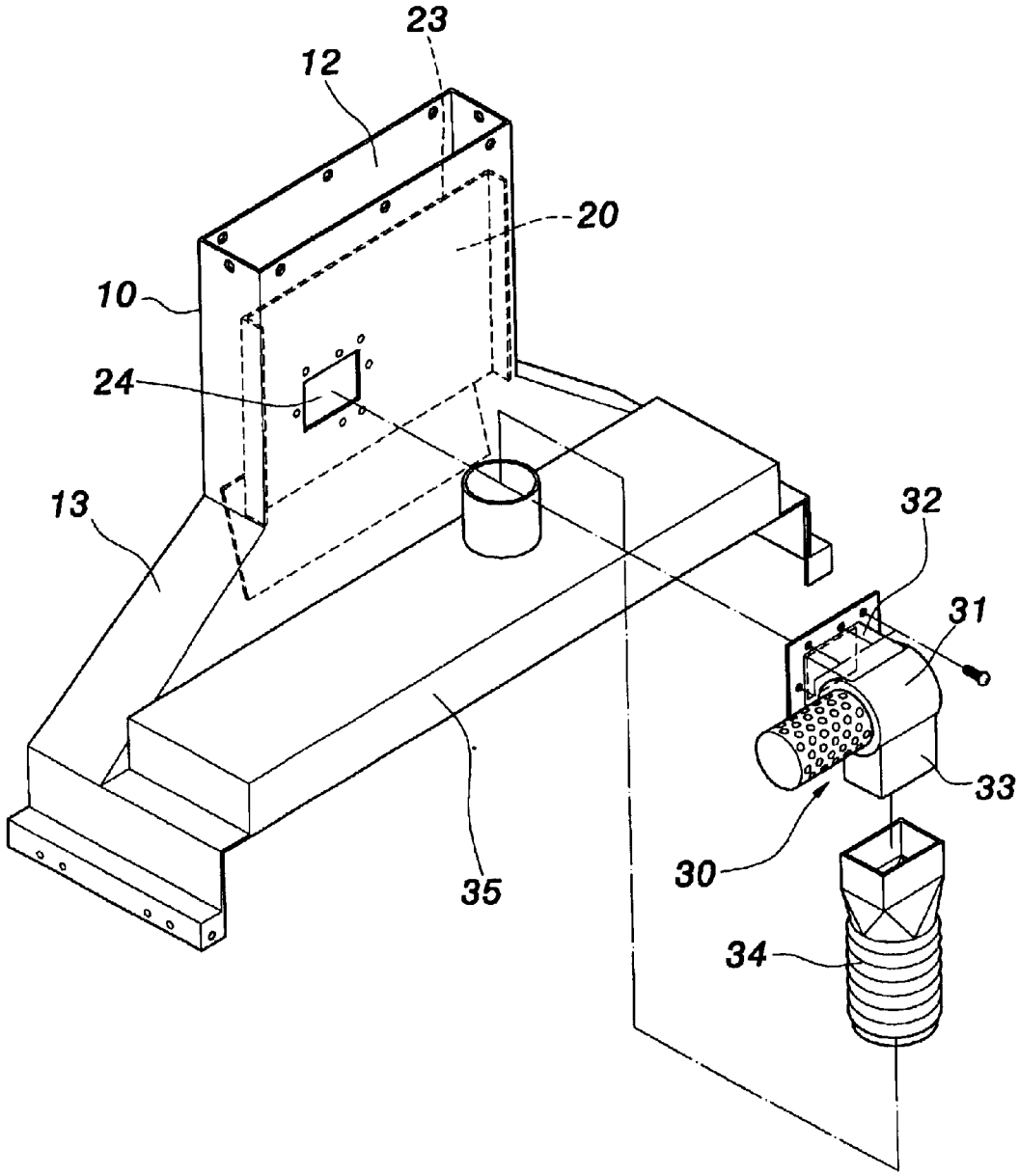
FIG. 2 is a perspective view showing an improved gas-exhausting module structure according to the present invention.
Figure 4:
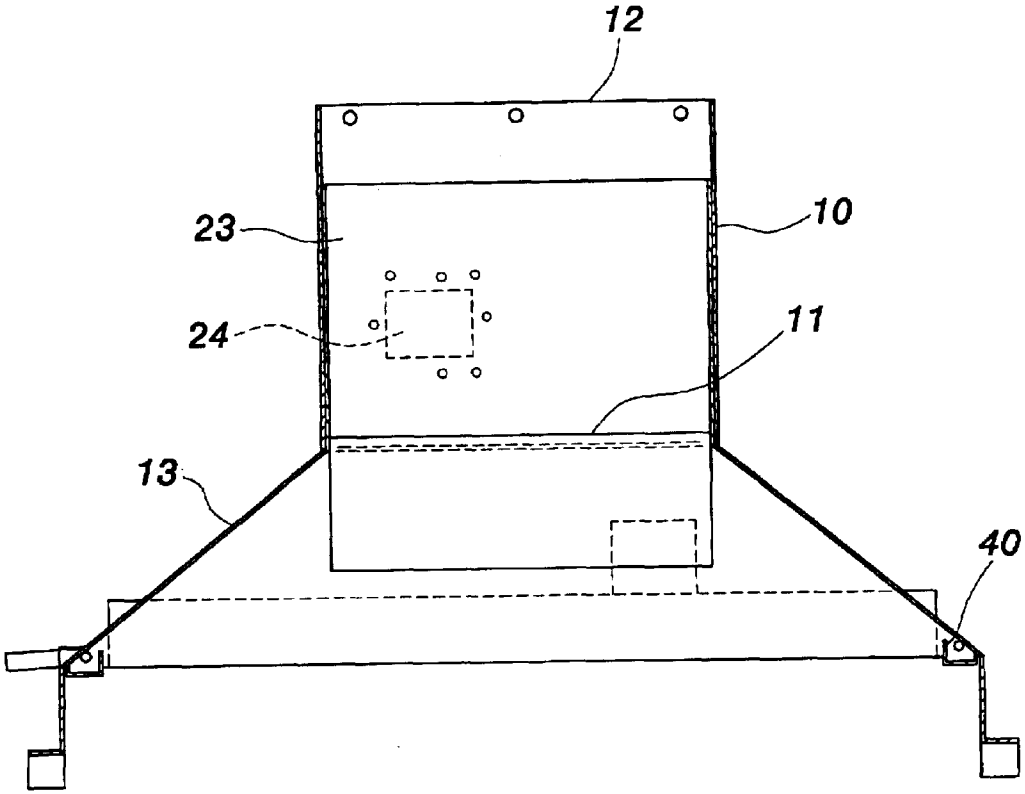
FIG. 4 is a front view showing the gas-exhausting module structure of FIG. 2.
Figure 3:
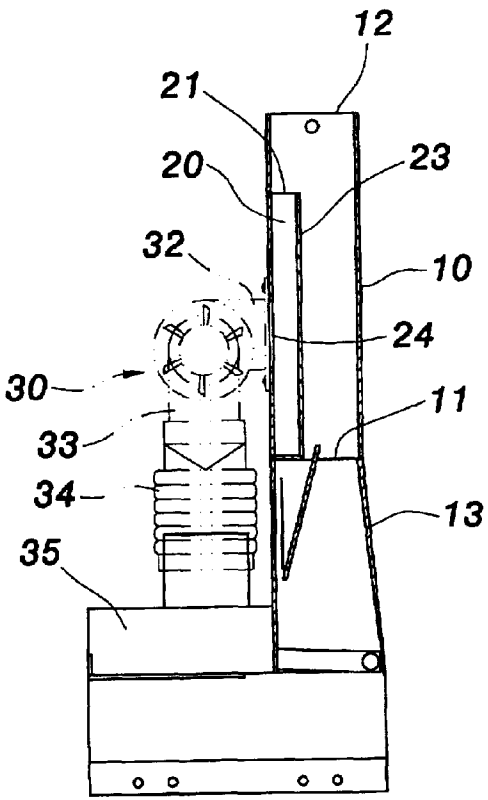
FIG. 3 is a side view showing the gas-exhausting module structure of FIG. 2.

Referring to FIG. 2 to FIG. 4, an improved gas-exhausting module structure according to the present invention is illustrated. The gas-exhausting module structure comprises a casing 10, an air exhausting channel 20, and a blower 30. The casing 10 is a hollow body and is preferably made of metals. The casing 10 has a first open end 11 and a second open end 12. Through a connection pipe 13, the first open end 11 is in communication with the gas zone 51 (best seen in continuous type oven. The casing 10 and the connection pipe 13 constitute a gas channel for expelling byproduct gas generated by the heater through the gas channel up to the second open end 12.

The air-exhausting channel 20 is disposed within the casing 10. According to the preferred embodiment of this invention, the air-exhausting channel 20 is defined by an inner separating plate 23 and sidewall of the casing 10, as best seen in FIG. 2 and FIG. 3. The air-exhausting channel 20 has an upper opening 21 that is lower than the second open end 12. At one side of the air-exhausting channel 20, there is an opening 24 provided on the sidewall of the casing 10.

The blower 30 is disposed outside the casing 10 and is mounted on the outer surface of the casing 10. The blower

30 comprises a chamber 31 in connection with an air outlet 32 and an air inlet 33. The air outlet 32 is connected to the opening 24 on the sidewall of the casing 10. The air inlet 33 is connected to one end of a flexible pipeline 34. The other end of the pipeline 34 is connected to an air sucking box 35. The air sucking box 35 is located directly above the gas zone 51 from where byproduct gas is generated while the heater of the continuous type oven is operated. When the power of the blower 30 is turned on, the air flows into the chamber 31 of the blower 30 through the air sucking box 35, the pipeline 34, and the air inlet 33, and then the air is expelled from the air outlet 32 and the opening 34 into the air exhausting channel 20. The high-pressure air is expelled from the upper opening 21 of the air-exhausting channel 20.

Figure 5:
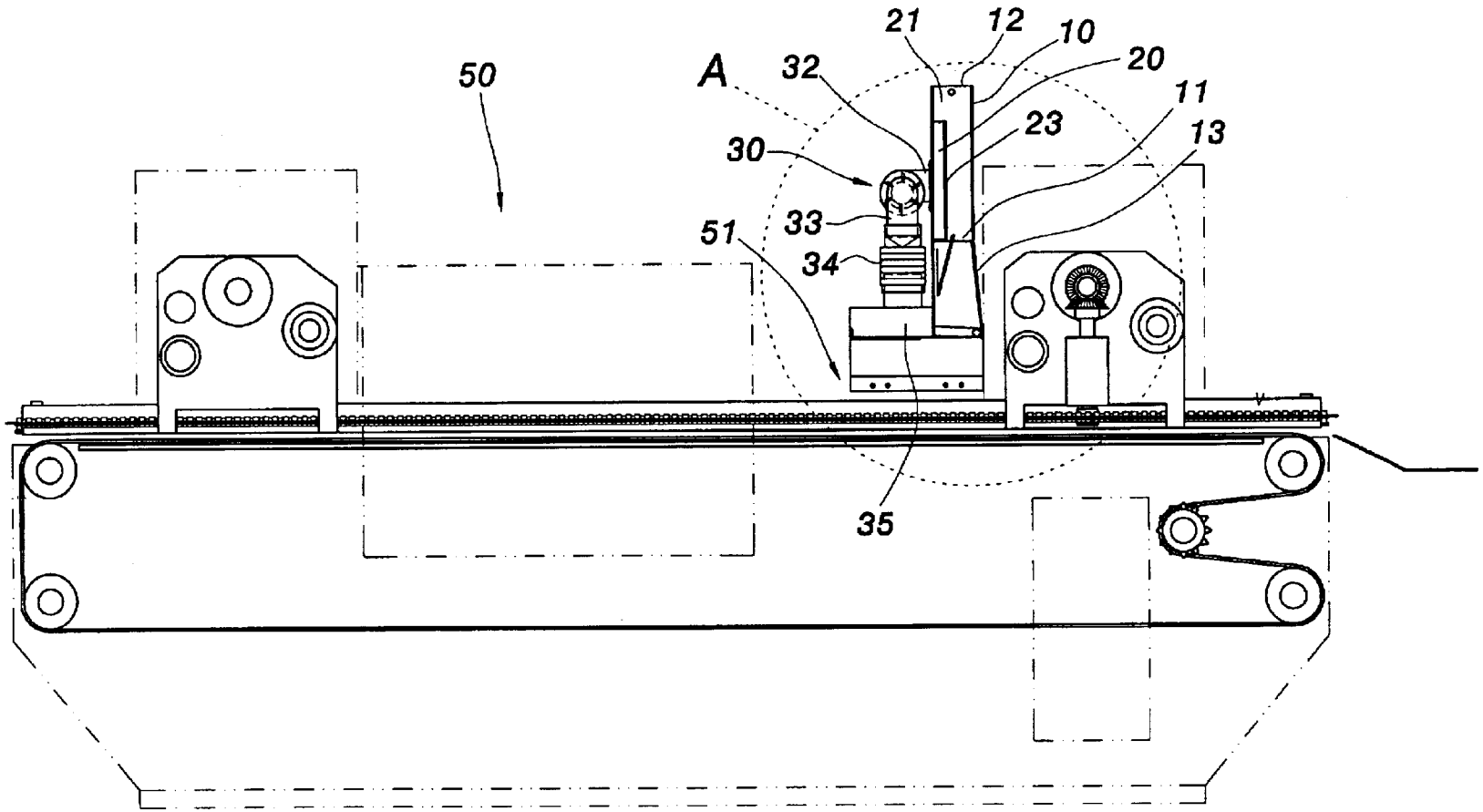
FIG. 5 is a schematic diagram illustrating the gas-exhausting module structure installed on the continuous type oven in accordance with this invention.
Figure 6:
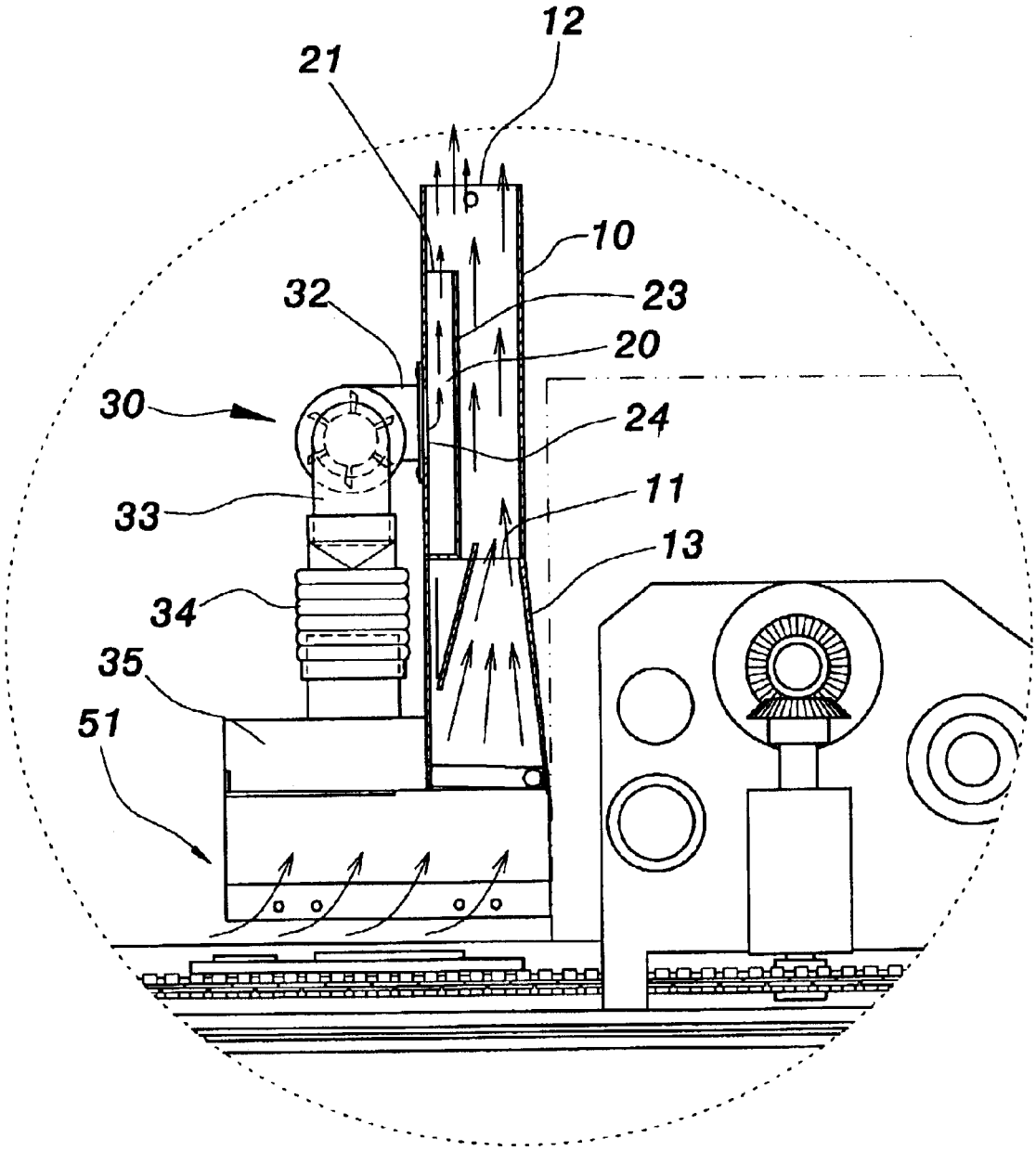
FIG. 6 is an enlarged side view of the gas-exhausting module structure, when in use.

Referring to FIG. 5 and FIG. 6, the gas-exhausting module structure according to the present invention is installed on the continuous type oven 50 or the like. Preferably, the gas-exhausting module structure is installed directly above the gas zone 51. When the power of the blower 30 is turned on, it sucks air and outputs high-pressure air through the upper opening 21 of the air exhausting channel 20. By doing this, gas byproducts can be carried out due to siphon effects, thereby resulting in better gas exhaust efficiency.

To sum up, the present invention provides an improved gas-exhausting module structure having a casing in which a separated air-exhausting channel 20 is provided. The air-exhausting channel 20 is defined by the separating plate 23 and the casing sidewall. When byproduct gas passes through the casing 10, residues will not adhere to sidewalls of the air-exhausting channel 20. The air-exhausting channel 20 has the upper opening 21 with large cross section area, and therefore clogging of the air-exhausting channel 20 is eliminated. Further, the prior art air compressor is replaced with the blower 30 for outputting high-pressure air, thereby saving cost. Moreover, a collecting channel may be disposed at the lower portion of the casing 10, as shown in FIG. 4, to collect condensed flux residue.

Figure 8:
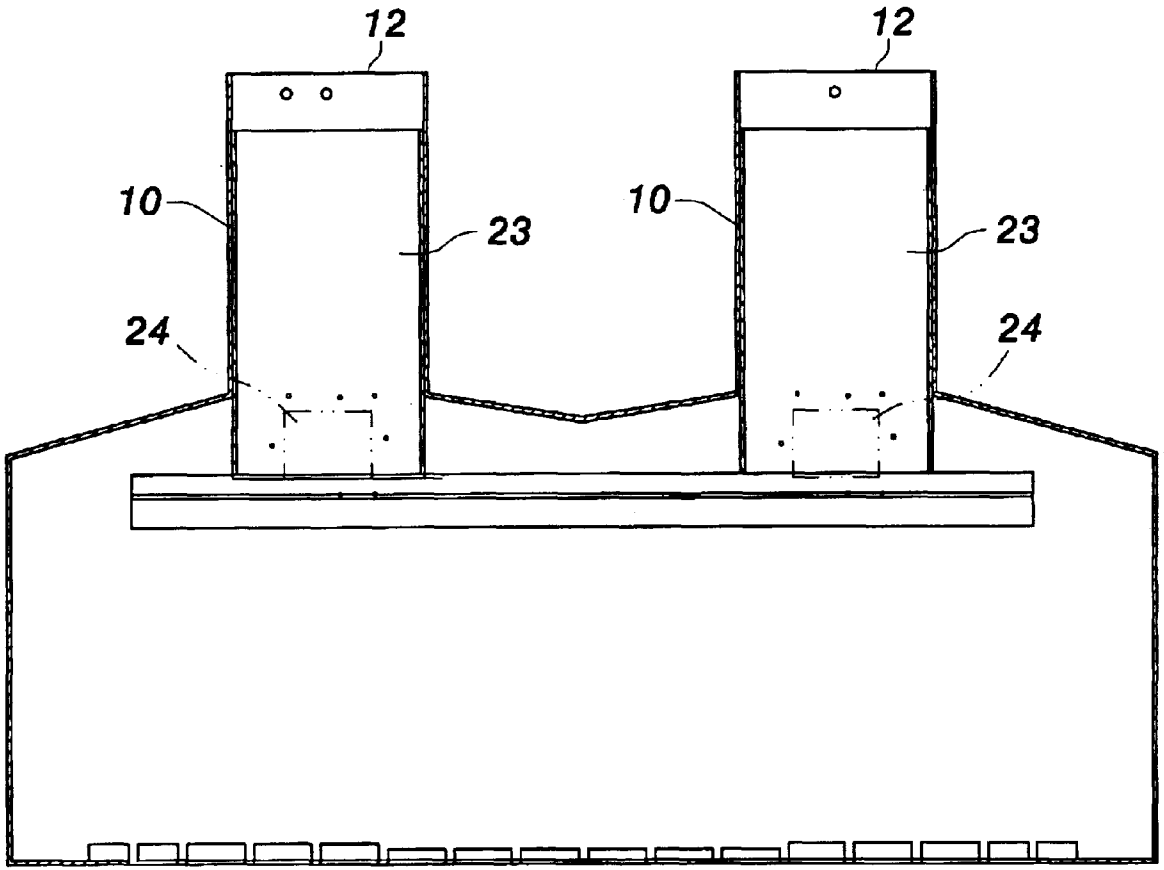
FIG. 8 is a front view showing the gas-exhausting module structure of another preferred embodiment.
Figure 7:
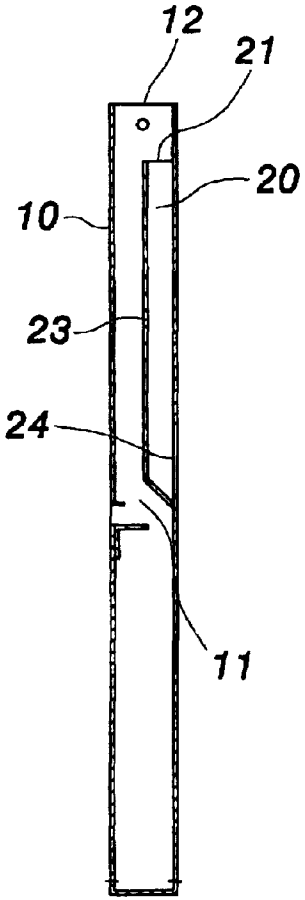
FIG. 7 is a side view showing the gas-exhausting module structure of another preferred embodiment.

FIG. 7 and FIG. 8 illustrate another preferred embodiment according to the present invention. A combination of two or three sets of the gas-exhausting module structure as described above may be used.

It is to be understood, however, that even though numerous characteristics and advantages of the present invention have been set forth in the foregoing description, together with details of the structure and function of the invention,the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A gas-exhausting module structure, comprising:

a casing having a first open end and a second open end and a sidewall portion defined about a gas exhaust channel extending therebetween;

a separating plate disposed at least partially within the gas exhausting channel of the casing to define an air exhausting channel internally against the sidewall portion thereof, the air exhausting channel having an upper opening that is lower than the second open end of the casing; and a blower comprising a chamber, an air outlet, and an air inlet, wherein the blower is in communication with the air exhausting channel, the air inlet of the blower is connected to an air sucking box, whereby responsive to actuation of the blower, air is drawn into the air exhausting channel and high-pressure air is expelled through the upper opening of the air exhausting channel.

2. The gas-exhausting module structure as claimed in claim 1 wherein through a connection pipe, the first open end is in communication with a gas zone from where byproduct gas is generated by a heater of a continuous type oven.

3. The gas-exhausting module structure as claimed in claim 1 wherein the separating plate includes a substantially planar portion spaced from and extending along an inner surface of the sidewall portion of the casing.

4. The gas-exhausting module structure as claimed in claim 1 wherein an opening is provide on the sidewall portion of the casing at one side of the air-exhausting channel and the air outlet of the blower is connected the opening.

5. The gas-exhausting module structure as claimed in claim 1 wherein the air inlet is connected to one end of a flexible pipeline, the other end of the pipeline being connected to the air sucking box located directly above a gas zone from where byproduct gas is generated by a heater of a continuous type oven.

6. The gas-exhausting module structure as claimed in claim 1 wherein a collecting channel is provide at a lower portion of the casing.

* * * * *